US007382991B2

(12) United States Patent
Choi

(10) Patent No.: US 7,382,991 B2
(45) Date of Patent: Jun. 3, 2008

(54) APPARATUS AND METHOD FOR DISPLAYING TONER RESIDUAL QUANTITY

(75) Inventor: Jeong-Jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 11/411,105

(22) Filed: Apr. 26, 2006

(65) Prior Publication Data

US 2006/0245770 A1 Nov. 2, 2006

(30) Foreign Application Priority Data

Apr. 27, 2005 (KR) ..... 10-2005-0034920

(51) Int. Cl.
*G03G 15/01* (2006.01)

(52) U.S. Cl. ..... 399/27

(58) Field of Classification Search ..... 399/27–30
See application file for complete search history.

(56) References Cited

U.S. PATENT DOCUMENTS

| | | | |
|---|---|---|---|
| 5,349,377 A | 9/1994 | Gilliland et al. | |
| 6,512,896 B2 | 1/2003 | Asanuma et al. | |
| 7,058,321 B2 * | 6/2006 | Kin | 399/27 |

FOREIGN PATENT DOCUMENTS

| | | | |
|---|---|---|---|
| JP | 2000-181214 | | 6/2000 |
| JP | 2001-337568 | | 12/2001 |
| JP | 2004- 294761 | | 10/2004 |
| JP | 2004-361752 | | 12/2004 |
| JP | 2005173088 A | * | 6/2005 |
| KR | 2001-10297 A | | 2/2001 |
| KR | 100389885 B1 | | 6/2006 |

OTHER PUBLICATIONS

Office Action issued on Jun. 26, 2006 in corresponding Korean Patent Application No. 2005-0034920.

* cited by examiner

*Primary Examiner*—Ryan Gleitz
(74) *Attorney, Agent, or Firm*—Stein, McEwen & Bui, LLP

(57) ABSTRACT

An apparatus and a method that displays a toner residual quantity includes: a calculation unit calculating a first prediction of toner residual quantity according to a dot count of printing data and calculating a second prediction of toner residual quantity according to a total actuating time of a toner supply motor; a determination unit determining whether the second prediction toner residual quantity is within a predetermined range of the first prediction toner residual quantity; and a user interface unit displaying the second prediction of toner residual quantity based on the determined result. A remaining amount value is displayed so that a user is informed of a toner replacement time.

23 Claims, 5 Drawing Sheets

FIG. 3

| IMAGE PATTERN | DOT COUNT PER CELL | AMOUNT OF TONER CONSUMED PER DOT (mg) | TOTAL AMOUNT OF TONER CONSUMPTION (mg) |
|---|---|---|---|
| K% | $C_k$ | $E_k$ | $F_t = \Sigma C_k * E_k$ |

FIG. 4

| DOT COUNT PER PAGE | AMOUNT OF TONER CONSUMED PER PAGE (mg) | TOTAL AMOUNT OF TONER CONSUMPTION (mg) |
|---|---|---|
| $X_n$ | $Y_n = 2.365E-6 * X_n - 0.44$ | $C_t = \Sigma Y_n$ |

APPARATUS AND METHOD FOR DISPLAYING TONER RESIDUAL QUANTITY

CROSS-REFERENCE TO RELATED APPLICATIONS

This application claims the benefit of Korean Patent Application No. 2005-34920, filed on Apr. 27, 2005, in the Korean Intellectual Property Office, the disclosure of which is incorporated herein in its entirety by reference.

BACKGROUND OF THE INVENTION

1. Field of the Invention

Aspects of the present invention relate to the determination and display of a toner residual quantity. More particularly, aspects of the present invention relate to an apparatus and a method of displaying a toner residual quantity in which it is determined whether or not a second prediction of toner residual quantity calculated based on the actuating time of a toner supply motor is within a predetermined range of a first prediction of toner residual quantity calculated using a dot count method and in which the second prediction of toner residual quantity is displayed based on the determined result.

2. Description of the Related Art

Printing machines or image forming apparatuses print an image on a sheet of paper by forming an electrostatic latent image, corresponding to data to be printed, which may be input from an external device, onto a photosensitive medium such as a photosensitive drum or a photosensitive belt, developing a toner image by supplying a predetermined developing agent such as a toner to the photosensitive medium on which the electrostatic latent image was formed, and transferring the toner image onto the sheet of paper.

Image forming apparatuses use a toner as an image forming medium. In image forming apparatuses, a toner amount is gradually reduced as an image is formed. Image forming apparatuses typically have an apparatus for sensing an amount by which toner is reduced in an image forming operation. This sensing may be done by a dot count method.

The dot count method is a method of analyzing a laser signal of an exposed laser scanning unit (LSU) in a developing unit, using this information to calculate how much toner will be used in an image forming apparatus and calculating a toner residual quantity by subtracting an amount of toner used from an original amount of toner. The time in which the laser signal is scanned has a proportional relationship with the amount of toner that is used in developing the image scanned by the laser signal. Therefore, the toner residual quantity can be predicted by using the proportional relationship.

Only, a problem occurs that accuracy cannot be guaranteed when calculating a toner residual quantity using the dot count method. That is, the toner usage of the image forming apparatus is affected by various variables, and these variables are overlooked when the toner residual quantity is calculated using the dot count method.

FIG. 1 is a graph that illustrates an error generated in case of calculating a toner residual quantity using a conventional dot count method. ⓪ represents an actual residual quantity of toner as a function of time. ② represents a calculated residual quantity of toner as a function of time if the amount of toner usage is overestimated and the amount of toner remaining is therefore underestimated. In such a case, a warning message informing a user that the toner supply must be replaced may be needlessly generated even though an adequate amount of toner remains. ③ represents a calculated residual quantity of toner if the amount of toner usage is underestimated and the amount of toner remaining is therefore overestimated. In such a case, a warning message informing a user that the toner supply must be replaced is not generated in time and the toner may run out in the middle of an image forming operation without the user being warned in advance.

That is, the conventional apparatus for displaying a toner residual quantity has a problem that a toner remaining amount value displayed may not be accurate and a user may not be adequately informed as to the exact time that a toner supply must be changed.

SUMMARY OF THE INVENTION

An aspect of the present invention provides an apparatus that displays a toner residual quantity in which it is determined whether or not a second prediction of toner residual quantity calculated based on the actuating time of a toner supply motor is within a predetermined range of a first prediction of toner residual quantity calculated using a dot count method and in which the second prediction of toner residual quantity is displayed based on the determined result.

An aspect of the present invention also provides a method of displaying a toner residual quantity in which it is determined whether or not a second prediction of toner residual quantity calculated based on the actuating time of a toner supply motor is within a predetermined range of a first prediction of toner residual quantity calculated using a dot count method and in which the second prediction of toner residual quantity is displayed based on the determined result.

An aspect of the present invention also provides a computer-readable recording medium having recorded thereon a program for executing the method of displaying a toner residual quantity in which it is determined whether or not a second prediction of toner residual quantity calculated based on the actuating time of a toner supply motor is within a predetermined range of a first prediction of toner residual quantity calculated using a dot count method and in which the second prediction of toner residual quantity is displayed based on the determined result.

According to an aspect of the present invention, there is provided an apparatus that displays a toner residual quantity, the apparatus including: a calculation unit that calculates a first prediction of toner residual quantity according to a dot count of printing data and that calculates a second prediction of toner residual quantity according to a total actuating time of a toner supply motor; a determination unit that determines whether or not the second prediction of toner residual quantity is within a predetermined range of the first prediction of toner residual quantity; and a user interface unit that displays the second prediction of toner residual quantity based on whether the second prediction of toner residual quantity is within a predetermined range of the first prediction of toner residual quantity.

According to an aspect of the present invention, the calculation unit may include: a first calculator that calculates a first toner residual quantity according to the number of all dots of the printing data; and a second calculator that calculates an amount of toner consumed per page according to a dot count of the printing data per page and that sums up the amount of toner consumed on every page of the printing data to calculate a second toner residual quantity, and wherein the first prediction of toner residual quantity is either the first toner residual quantity or the second toner residual quantity.

According to an aspect of the present invention, the apparatus may further include a sensing unit that senses whether or not the toner is actually supplied by the toner supply motor, wherein the calculation unit calculates the second prediction of toner residual quantity using the amount of time that the toner is actually supplied, as sensed by the sensing unit.

According to an aspect of the present invention, the determination unit may determine whether or not the second prediction of toner residual quantity is within a predetermined range of the first toner residual quantity and the second toner residual quantity.

According to an aspect of the present invention, the apparatus may further include a storage unit that stores a first prediction of toner residual quantity at an address having the dot count and that stores a second prediction of toner residual quantity at an address having the total actuating time of the toner supply motor, wherein the calculation unit calculates the first toner residual quantity by reading out from the storage unit the first toner residual quantity at the address having the dot count and calculates the second toner residual quantity by reading out from the storage unit the second toner residual quantity at the address having the total actuating time.

According to an aspect of the present invention, the determination unit may include: a first determination portion that determines whether or not the second prediction of toner residual quantity is within a predetermined range of the first prediction of toner residual quantity; and a second determination portion that determines whether or not the second prediction of toner residual quantity is smaller than a predetermined threshold value, and wherein the user interface unit provides a notification of a shortage of toner if the second prediction of toner residual quantity is smaller than the predetermined threshold value.

According to another aspect of the present invention, there is provided a method of displaying a toner residual quantity, the method including: calculating a first prediction of toner residual quantity according to a dot count of printing data and calculating a second prediction of toner residual quantity according to a total actuating time of a toner supply motor; determining whether or not the second prediction of toner residual quantity is within a predetermined range of the first prediction of toner residual quantity; and if the second prediction of toner residual quantity is within the predetermined range of the first prediction of toner residual quantity, displaying the second prediction of toner residual quantity based on the determined result.

According to an aspect of the present invention, the calculating of the first prediction of toner residual quantity and the calculating of the second prediction of toner residual quantity may include: calculating a first toner residual quantity according to the number of all dots of the printing data; and calculating an amount of toner consumed per page according to a dot count of the printing data per page and summing up the amount of toner consumed on every page of the printing data to calculate a second toner residual quantity, and wherein the first prediction of toner residual quantity is either the first toner residual quantity or the second toner residual quantity.

According to an aspect of the present invention, the method may further include sensing whether or not the toner is actually supplied by the toner supply motor, wherein the calculating of the first prediction of toner residual quantity and the calculating of the second prediction of toner residual quantity is calculated according to an amount of time that the toner is actually supplied, as sensed by the sensing unit.

According to an aspect of the present invention, the determining of whether or not the second prediction of toner residual quantity is within the predetermined range of the first prediction of toner residual quantity may include determining whether or not the second prediction of toner residual quantity is within the predetermined range of either the first toner residual quantity or the second toner residual quantity.

According to an aspect of the present invention, the determining of whether or not the second prediction of toner residual quantity is within the predetermined range of the first prediction of toner residual quantity may include determining whether or not the second prediction of toner residual quantity is smaller than a predetermined threshold value, and wherein, if the second prediction of toner residual quantity is smaller than the predetermined threshold value, then the displaying of the second prediction of toner residual quantity comprises providing a notification of a shortage of toner.

According to another aspect of the present invention, there is provided a computer-readable recording medium having recorded thereon an executable program that controls an apparatus that displays a toner residual quantity according to a process including: calculating a first prediction of toner residual quantity according to a dot count of printing data and calculating a second prediction of toner residual quantity according to a total actuating time of a toner supply motor; determining whether or not the second prediction of toner residual quantity is within a predetermined range of the first prediction of toner residual quantity; and if the second prediction of toner residual quantity is within the predetermined range of the first prediction of toner residual quantity, displaying the second prediction of toner residual quantity.

According to another aspect of the present invention, there is provided an image forming apparatus that displays a toner residual quantity, comprising: a toner supply unit that includes a toner supply motor; a developing unit that consumes toner supplied by the toner supply motor; a calculation unit that calculates a first prediction of a toner residual quantity in the toner supply unit according to a dot count of printing data and that calculates a second prediction of toner residual quantity according to a total actuating time of the toner supply motor; a determination unit that determines whether or not the second prediction of toner residual quantity is within a predetermined range of the first prediction of toner residual quantity; and a user interface unit that displays the second prediction of toner residual quantity if the second prediction of toner residual quantity is within a predetermined range of the first prediction of toner residual quantity.

According to another aspect of the present invention, there is provided an apparatus that calculates a toner residual quantity and that comprises a calculation unit that calculates a first prediction of toner residual quantity according to a dot count of printing data and that calculates a second prediction of toner residual quantity according to a total actuating time of a toner supply motor; and a determination unit that determines whether the second prediction of toner residual quantity is within a predetermined range of the first prediction of toner residual quantity.

According to another aspect of the present invention, there is provided a method of calculating a toner residual quantity by calculating a first prediction of toner residual quantity according to a dot count of printing data and calculating a second prediction of toner residual quantity according to a total actuating time of a toner supply motor and determining whether the second prediction of toner residual quantity is within a predetermined range of the first prediction of toner residual quantity.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 3 is a reference table for calculating a first toner residual quantity;

FIG. 4 is a reference table for calculating a second toner residual quantity;

DETAILED DESCRIPTION OF THE EMBODIMENTS

Figure 1:
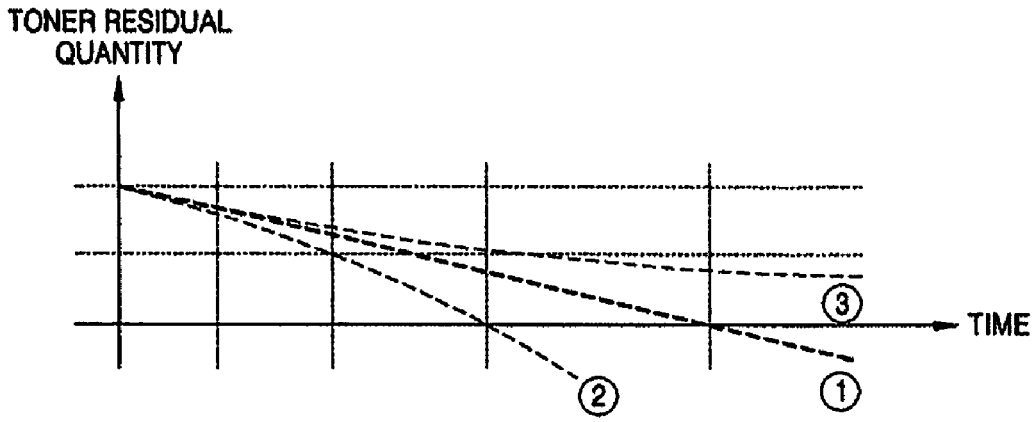
FIG. 1 (PRIOR ART)
FIG. 1 is a graph showing possible errors that can be generated in calculating a toner residual quantity using a conventional dot count method.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
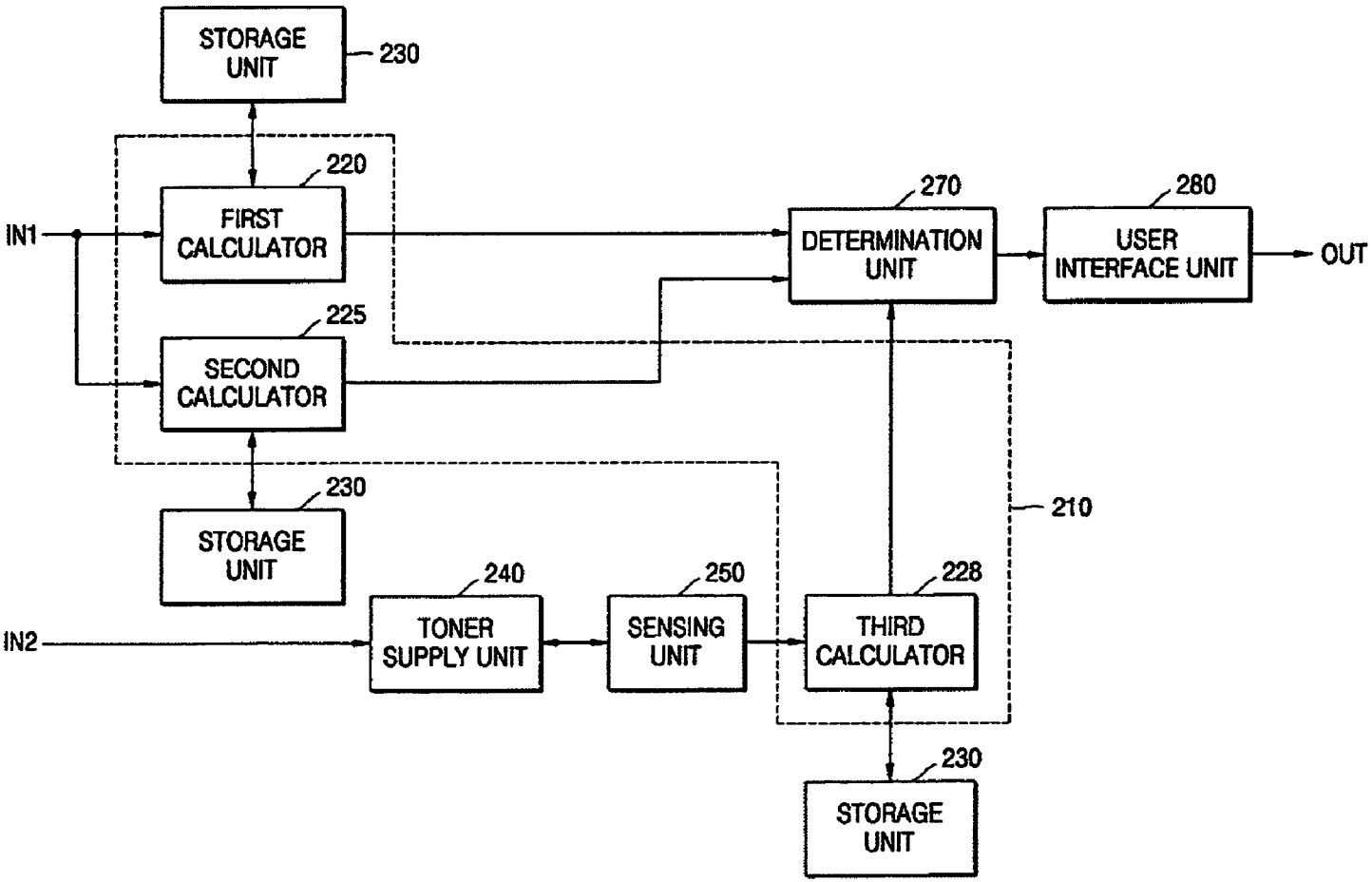
FIG. 2 is a block diagram of an apparatus that displays a toner residual quantity according to an embodiment of the present invention.

FIG. 2 is a block diagram of an apparatus that displays a toner residual quantity according to an embodiment of the present invention. The apparatus of FIG. 2 includes a calculation unit 210, a storage unit 230, a toner supply unit 240, a sensing unit 250, a determination unit 270, and a user interface unit 280.

In FIG. 2, IN1 is predetermined data to be printed, IN2 is a predetermined instruction for forming an image, and OUT is a toner residual quantity that is displayed. As a non-limiting example, the apparatus for displaying a toner residual quantity may be connected to a host, and IN1 and IN2 may be supplied from the host. Alternatively, IN1 and IN2 may be scanned data supplied by an image forming device in which the apparatus for displaying a toner residual quantity is included.

The printing data IN1 is data corresponding to a document comprising at least one or a plurality of pages and may be recognized by an image forming apparatus that includes the apparatus for displaying a toner residual quantity.

The calculation unit 210 includes a first calculator 220, a second calculator 225, and a third calculator 228. The first calculator 220 and the second calculator 225 calculate a first prediction of toner residual quantity according to a dot count method.

More specifically, the first calculator 220 calculates a first toner residual quantity according to a total dot count of the printing data IN1. The second calculator 225 calculates an amount of toner consumed per page according to a dot count per page of printing data and sums up the amount of toner consumed on every page of the printing data IN1 to calculate a second toner residual quantity. The term "first prediction of toner residual quantity" refers to either the first toner residual quantity or the second toner residual quantity.

On the other hand, the third calculator 228 calculates a second prediction of toner residual quantity according to a total actuating time of a toner supply motor.

The toner supply motor may be installed in the toner supply unit, which can be, for example, a toner cartridge and supplies a toner to a developing unit. The developing unit develops an electrostatic latent image formed on a photosensitive drum using the toner. The developing unit may be separable from the toner cartridge or may be integrally formed with the toner cartridge.

The storage unit 230 stores the first prediction of toner residual quantity at an address having the dot count and stores the second prediction of toner residual quantity at an address having the total actuating time of the toner supply motor. The dot count may be the number of all dots of the printing data or the number of dots per page of the printing data.

The first calculator 220 calculates the first toner residual quantity by reading the first toner residual quantity having the address of the number of all dots that form the printing data IN1, from the storage unit 230. In the same way, the second calculator 225 calculates the second toner residual quantity by reading the second toner residual quantity having the address of the dot count that forms the printing data IN1 per page, from the storage unit 230. Furthermore, the third calculator 228 calculates the second prediction of toner residual quantity by reading the second prediction of toner residual quantity having the address of the total actuating time of the toner supply motor, from the storage unit 230.

The toner supply unit 240 supplies the toner to the developing unit by actuating the toner supply motor according to the image formation instruction IN2, such as, for example, a printing instruction. To this end, the toner supply unit 240 may include the toner supply motor.

The sensing unit 250 senses whether or not the toner is actually supplied to the developing unit based on the actuation of the toner supply motor. In this case, the third calculator 228 may calculate the second prediction of toner residual quantity based on the sensed result from the sensing unit 250. That is, the third calculator 228 may calculate the second prediction of toner residual quantity using the time in which the toner is actually supplied to the developing unit, as sensed by the sensing unit 250.

The sensing unit 250 may also sense the amount of the toner supplied to the developing unit. The sensing unit 250 may control the actuation of the toner supply motor according to the sensed value.

The determination unit 270 determines whether or not the second prediction of toner residual quantity is within a preset range of the first prediction of toner residual quantity. That is, the determination unit 270 determines whether or not the second prediction of toner residual quantity is within the preset or predetermined range of the first and/or second toner residual quantity.

The user interface unit 280 displays the second prediction of toner residual quantity based on the determined result of the determination unit 270. In particular, the user interface unit 280 displays the second prediction of toner residual quantity if the second prediction of toner residual quantity is within the predetermined range of the first and/or second toner residual quantity. Furthermore, the user interface unit 280 informs a user that there is a shortage of toner when the second prediction of toner residual quantity is smaller than a predetermined reference value. To this end, the determination unit 270 may include a first determination portion (not shown) which determines whether or not the second prediction of toner residual quantity is within a predetermined range of the first prediction of toner residual quantity and a second determination portion (not shown) which determines whether or not the second prediction of toner residual quantity is smaller than the predetermined value. In this case, the user interface unit 280 informs the user that there is a shortage of toner based on the determined result from the second determination portion (not shown).

The user interface unit 280 is not limited to a visual display unit, but may include other types of units that provide notification to a user. For example; the user interface unit may communicate by voice or audible signals or may inform a user of a shortage of toner by changing a behavior of an image forming apparatus.

The amount of the toner supplied to the developing unit is typically equal to the amount of the toner consumed. In addition, if it is sensed that the toner is actually supplied to the developing unit, the total actuating time of the toner supply motor indicates the total amount of the toner supplied to the developing unit.

It has been already described that the toner usage of the image forming apparatus is affected by the external environment. Thus, there is a large possibility that a residual quantity predicted using the dot count method does not coincide exactly with the actual amount of toner that is remaining in a toner supply unit.

On the other hand, when a value for a remaining amount of toner is predicted based on the total actuating time of the toner supply motor, the actuating time of the toner supply motor is generally an accurate indicator of the toner usage. Thus, the second prediction of toner residual quantity may provide greater accuracy than the first prediction of toner residual quantity.

Thus, aspects of the present invention provide for displaying the second prediction of toner residual quantity as the actual remaining amount value. Furthermore, aspects of the present invention provide for calculating the second prediction of toner residual quantity only when the toner is actually supplied to the developing unit, so as to provide greater accuracy of the actual remaining amount of toner, and for displaying the second prediction of toner residual quantity only when the second prediction of toner residual quantity is approximate with the first prediction of toner residual quantity within a predetermined or preset range.

FIG. 3 is a reference table for calculating the first toner residual quantity. Referring to FIG. 3, the first toner residual quantity can be calculated using Equation 1.

$$F_t = \sum_{k=0}^{100} C_k E_k \tag{1}$$

where k is a value of an image pattern expressed as a percentage, and $C_k$ is a dot count per cell when an image pattern is k %. In addition, $E_k$ is a toner consumption amount expected per dot, and $F_t$ is a total amount of toner consumption expected to print the printing data IN1.

A document has a plurality of cells per page. In this case, each cell has an image, and the ratio of the image taken in the cell is the image pattern k. For example, each letter in the document is included in a cell, and the percentage ratio of the area of the letter to the entire area of the cell is k.

In this case, the first toner residual quantity is obtained by subtracting $F_t$ from the amount of toner that exists before the printing data IN1 is inputted.

FIG. 4 is a reference table for calculating a second toner residual quantity. Referring to FIG. 4, the second toner residual quantity can be calculated using Equation 2.

$$C_t = \sum_n Y_n \tag{2}$$

where $C_t$ is a total amount of toner consumption expected to print the printing data IN1, n is the total number of pages, $X_n$ is a dot count per page, and $Y_n$ is a factor of $X_n$ and refers to the toner consumption amount expected per page. In this case, the second toner residual quantity is obtained by subtracting $C_t$ from the amount of toner that exists before the printing data IN1 is inputted.

Figure 5:
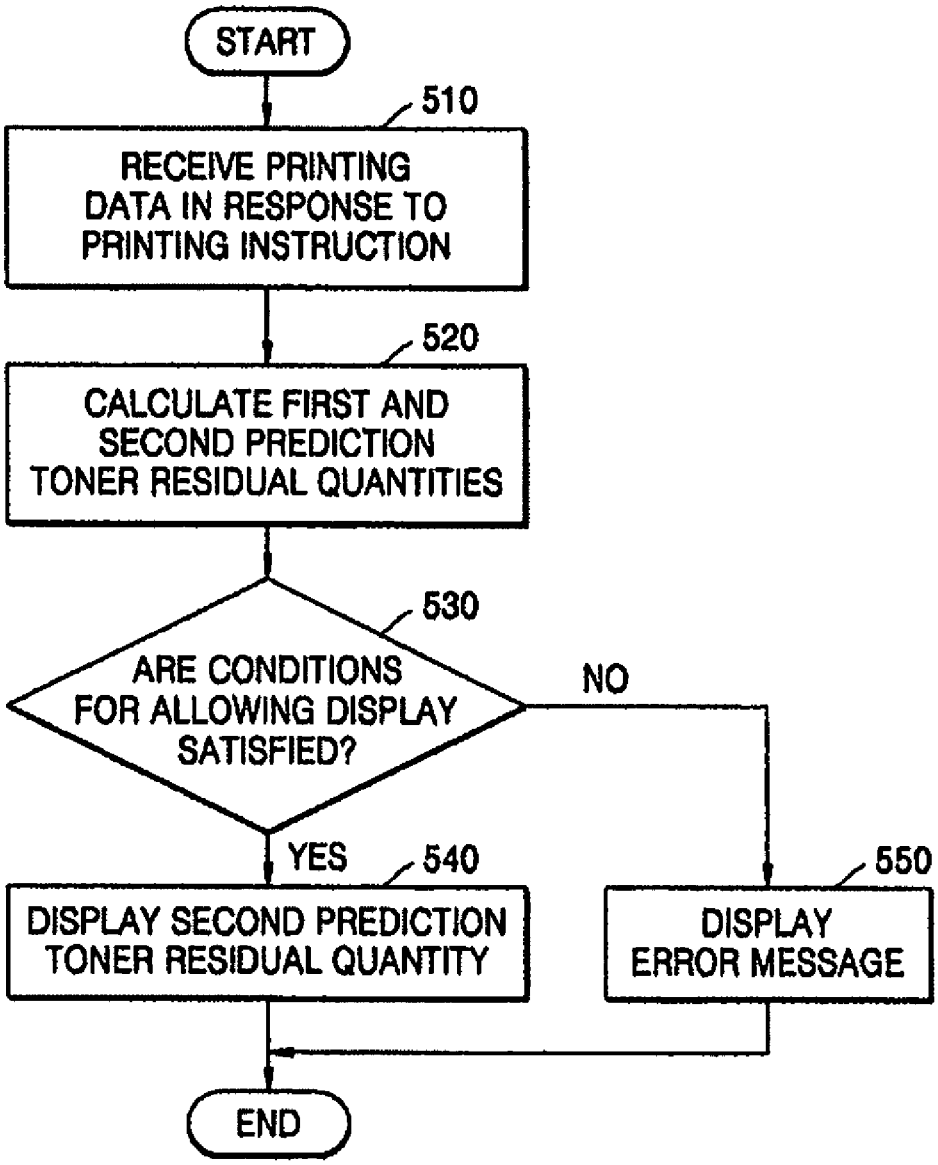
FIG. 5 is a flowchart illustrating a method of displaying a toner residual quantity according to an embodiment of the present invention.

FIG. 5 is a flowchart that illustrates a method of displaying a toner residual quantity according to an embodiment of the present invention. The method of FIG. 5 includes calculating first and second prediction of toner residual quantities in response to a printing instruction (operations 510-520) and determining whether or not conditions for allowing display are satisfied and displaying the second prediction of toner residual quantity based on the determined result (operations 530-550).

If the printing data IN1 is given with the image formation instruction IN2 in operation 510, the calculation unit 210 calculates the first prediction of toner residual quantity and the second prediction of toner residual quantity in operation 520. In this case, the second prediction of toner residual quantity is calculated using a time in which the toner is actually supplied to the developing unit as sensed by the sensing unit 250.

The determination unit 270 determines whether or not the second prediction of toner residual quantity can be displayed as an actual toner residual quantity in operation 530. That is, the determination unit 270 determines whether or not the second prediction of toner residual quantity is within a predetermined range of the first prediction of toner residual quantity.

If it is determined that the second prediction of toner residual quantity is within the predetermined range of the first prediction of toner residual quantity in operation 530, the user interface unit 280 displays the second prediction of toner residual quantity in operation 540. On the other hand, if it is determined in operation 530 that the second prediction of toner residual quantity is not within the predetermined range of the first prediction of toner residual quantity, the user interface unit 280 in operation 550 displays an error message such as "toner residual quantity cannot be displayed."

Figure 6:
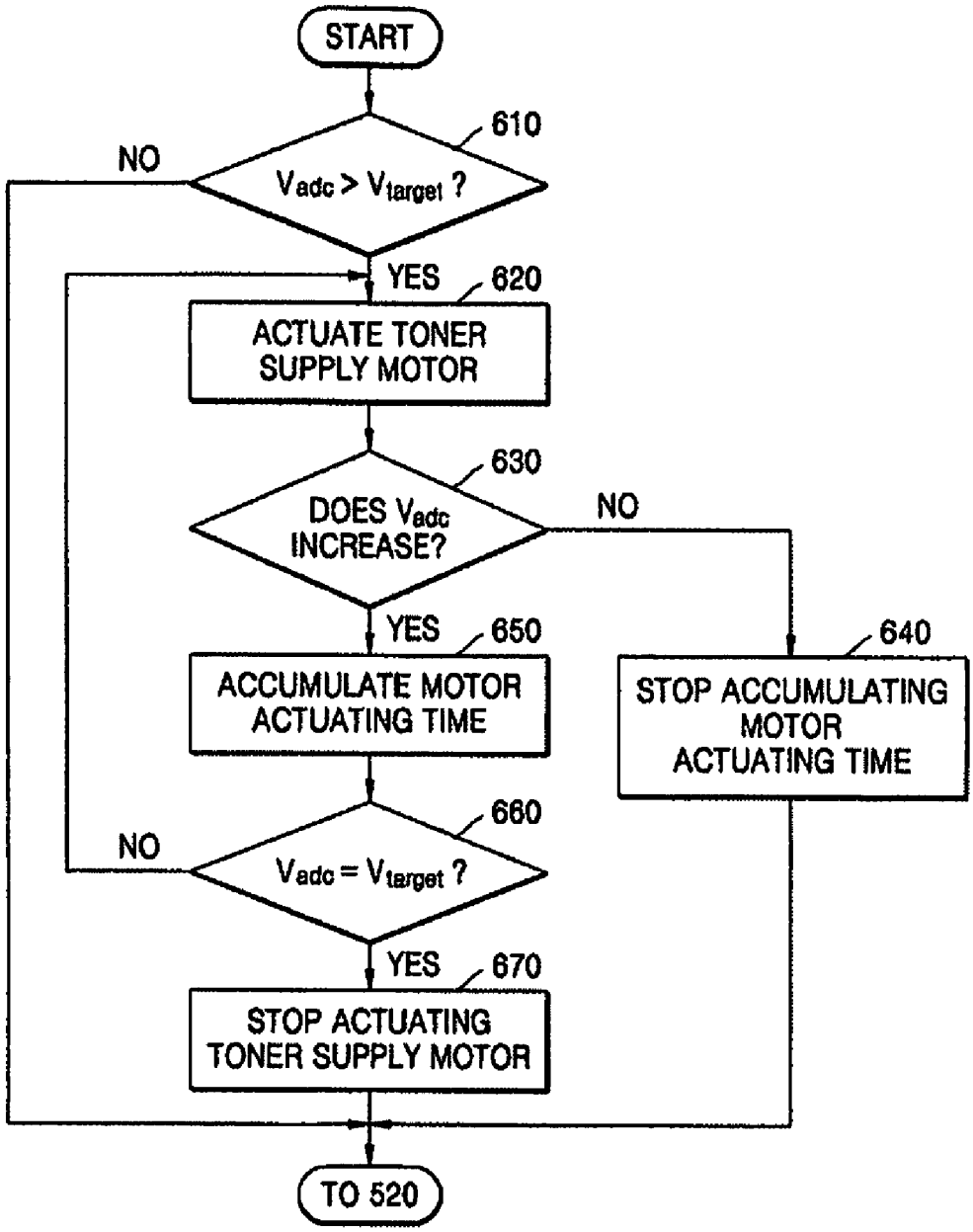
FIG. 6 is a flowchart illustrating operation 510 illustrated in FIG. 5.

FIG. 6 is a flowchart that shows operation 510 from FIG. 5 in greater detail. Here, $V_{adc}$ is a current voltage sensed by a developing unit, and $V_{target}$ is a target voltage to be sensed by the developing unit. When the toner is supplied from a toner cartridge to the developing unit, $V_{adc}$ is decreased.

The toner supply unit 240 actuates a toner supply motor in response to the predetermined image formation instruction IN2, and the sensing unit 250 in operation 610 senses whether or not the toner is actually supplied to the developing unit.

If it is sensed that $V_{adc}$ is smaller than or equal to $V_{target}$ in operation 610, the amount of the toner to be supplied has been already supplied to the developing unit. In this case, the method proceeds to operation 520.

If it is sensed that $V_{adc}$ is larger than $V_{target}$ in operation 610, the amount of the toner to be supplied has not sufficiently been supplied to the developing unit. In this case, in operation 620, the toner supply unit 240 actuates the toner supply motor continuously.

At this time, the sensing unit 250 determines whether or not $V_{adc}$ decreases in operation 630. If it is determined that $V_{adc}$ does not decrease as the determined result, the toner supply unit 240 stops actuating the toner supply motor, and the third calculator 228 stops accumulating the motor actuating time in operation 640.

On the contrary, if it is determined that $V_{adc}$ decreases in operation 630, the toner supply unit 240 actuates the toner supply motor continuously, and the third calculator 228 accumulates the motor actuating time continuously in operation 650.

After operation 650, the sensing unit 250 determines whether or not $V_{adc}$ is equal to $V_{target}$ in operation 660. If it is determined that $V_{adc}$ is not equal to $V_{target}$, the method returns to operation 620. However, if it is determined that $V_{adc}$ is equal to $V_{target}$, the toner supply unit 240 stops actuating the toner supply motor, and the third calculator stops accumulating the motor actuating time in operation 670. Here, when $V_{adc}$ is equal to $V_{target}$ it means that the amount of the toner to be supplied has been already supplied to the developing unit.

The third calculator 228 calculates the second prediction of toner residual quantity using the accumulated motor actuating time.

Aspects of the invention can also be embodied as computer readable codes on a computer readable recording medium. The computer readable recording medium may be any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

As described above, in the apparatus and method for displaying a toner residual quantity according to the present invention, a remaining amount value that is displayed has a greater accuracy so that an exact toner replacement time is informed to the user. Furthermore, the user can know whether or not the toner is authentic.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus that calculates a toner residual quantity, the apparatus comprising:

a calculation unit that calculates a first prediction of toner residual quantity according to a dot count of printing data and that calculates a second prediction of toner residual quantity according to a total actuating time of a toner supply motor; and a determination unit that determines whether the second prediction of toner residual quantity is within a predetermined range of the first prediction of toner residual quantity.

2. The apparatus of claim 1, wherein the determination unit further determines whether the second prediction of toner residual quantity is smaller than a predetermined threshold value.

3. The apparatus of claim 1, further comprising a user interface unit that provides a notification of the second prediction of toner residual quantity if the second prediction of toner residual quantity is within a predetermined range of the first prediction of toner residual quantity.

4. The apparatus of claim 1, wherein the user interface unit provides a notification of a shortage of toner if the second prediction of toner residual quantity is smaller than the predetermined threshold value.

5. A method of calculating a toner residual quantity, the method comprising:

calculating a first prediction of toner residual quantity according to a dot count of printing data and calculating a second prediction of toner residual quantity according to a total actuating time of a toner supply motor; and determining whether the second prediction of toner residual quantity is within a predetermined range of the first prediction of toner residual quantity.

6. The method of claim 5, further comprising providing a notification of toner residual quantity if the second prediction of toner residual quantity is within the predetermined range of the first prediction of toner residual quantity.

7. The method of claim 6, further comprising determining whether the second prediction of toner residual quantity is smaller than a predetermined threshold value, and providing a notification of a shortage of toner if the second prediction of toner residual quantity is smaller than the predetermined threshold value.

8. An apparatus that displays a toner residual quantity, the apparatus comprising:

a calculation unit that calculates a first prediction of toner residual quantity according to a dot count of printing data and that calculates a second prediction of toner residual quantity according to a total actuating time of a toner supply motor;

a determination unit that determines whether the second prediction of toner residual quantity is within a predetermined range of the first prediction of toner residual quantity; and a user interface unit that displays the second prediction of toner residual quantity if the second prediction of toner residual quantity is within a predetermined range of the first prediction of toner residual quantity.

9. The apparatus of claim 8, wherein the calculation unit comprises:

a first calculator that calculates a first toner residual quantity according to a number of all dots of the printing data; and a second calculator that calculates an amount of toner consumed per page according to a dot count of the printing data per page and that sums up the amount of toner consumed on every page of the printing data to calculate a second toner residual quantity, and wherein the first prediction of toner residual quantity is either the first toner residual quantity or the second toner residual quantity.

10. The apparatus of claim 8, further comprising a sensing unit that senses whether the toner is actually supplied by the toner supply motor, wherein the calculation unit calculates the second prediction of toner residual quantity using an amount of time that the toner is actually supplied, as sensed by the sensing unit.

11. The apparatus of claim 8, wherein the first calculator calculates the first toner residual quantity by calculating an amount of toner consumed to print all dots of inputted printing data and subtracting the amount of toner consumed from an amount of toner that exists before the printing data is inputted, wherein the second calculator calculates a second toner residual quantity by calculating an amount of toner consumed per page according to a dot count of inputted printing data per page, summing up the amount of toner consumed on every page of the printing data to calculate the amount of toner consumed to print all pages of the printing data and subtracting the amount of toner consumed from an amount of toner that exists before the printing data is inputted, and wherein the apparatus further includes a third calculator that calculates a second prediction of toner residual quantity by determining an amount of toner consumed according to a total actuating time of a toner supply motor and subtracting the amount of toner consumed from an amount of toner that existed before the toner supply motor is actuated.

12. The apparatus of claim 9, wherein the determination unit determines whether the second prediction of toner residual quantity is within a predetermined range of either the first toner residual quantity or the second toner residual quantity.

13. The apparatus of claim 8, further comprising a storage unit that stores a first prediction of toner residual quantity at an address having the dot count and that stores a second prediction of toner residual quantity at an address having the total actuating time of the toner supply motor, wherein the calculation unit calculates the first toner residual quantity by reading out the first toner residual quantity at the address from the storage unit having the dot count and calculates the second toner residual quantity by reading out the second toner residual quantity at the address from the storage unit having the total actuating time.

14. The apparatus of claim 8, wherein the determination unit comprises:

a first determination portion that determines whether the second prediction of toner residual quantity is within a predetermined range of the first prediction of toner residual quantity; and a second determination portion that determines whether the second prediction of toner residual quantity is smaller than a predetermined threshold value, and wherein the user interface unit provides a notification of a shortage of toner if the second prediction of toner residual quantity is smaller than the predetermined threshold value.

15. A method of displaying a toner residual quantity, the method comprising:

calculating a first prediction of toner residual quantity according to a dot count of printing data and calculating a second prediction of toner residual quantity according to a total actuating time of a toner supply motor;

determining whether the second prediction of toner residual quantity is within a predetermined range of the first prediction of toner residual quantity; and if the second prediction of toner residual quantity is within the predetermined range of the first prediction of toner residual quantity, displaying the second prediction of toner residual quantity.

16. The method of claim 15, wherein if the second prediction of toner residual quantity is not within the predetermined range of the first prediction of toner residual quantity, the method includes displaying an error message.

17. The method of claim 15, wherein the calculating of the first prediction of toner residual quantity and the calculating of the second prediction of toner residual quantity comprises:

calculating a first toner residual quantity according to the number of all dots of the printing data; and calculating an amount of toner consumed per page according to a dot count of the printing data per page and summing up the amount of toner consumed on every page of the printing data to calculate a second toner residual quantity, and wherein the first prediction of residual quantity is either the first toner residual quantity or the second toner residual quantity.

18. The method of claim 15, further comprising sensing whether the toner is actually supplied by the toner supply motor, wherein the second prediction of toner residual quantity is calculated according to an amount of time that the toner is actually supplied, as sensed by the sensing unit.

19. The method of claim 18, wherein an amount of time that toner is actually supplied is controlled by sensing a current voltage in a developing unit to which the toner is supplied, which current voltage varies according to an amount of toner supplied to the developing unit and stopping an actuation of the toner supply motor when the current voltage is equal to a target voltage.

20. The method of claim 17, wherein the determining of whether the second prediction of toner residual quantity is within the predetermined range of the first prediction of toner residual quantity comprises determining whether the second prediction of toner residual quantity is within the predetermined range of either the first toner residual quantity or the second toner residual quantity.

21. The method of claim 15, wherein the determining of whether the second prediction of toner residual quantity is within the predetermined range of the first prediction of toner residual quantity comprises determining whether the second prediction of toner residual quantity is smaller than a predetermined threshold value, and wherein, if the second prediction of toner residual quantity is smaller than the predetermined threshold value, the displaying of the second prediction of toner residual quantity comprises providing a notification of a shortage of toner.

22. A computer-readable recording medium having recorded thereon an executable program that controls an apparatus that displays a toner residual quantity according to a process comprising:

calculating a first prediction of toner residual quantity according to a dot count of printing data and calculating a second prediction of toner residual quantity according to a total actuating time of a toner supply motor;

determining whether the second prediction of toner residual quantity is within a predetermined range of the first prediction toner residual quantity; and if the second prediction of toner residual quantity is within the predetermined range of the first prediction of toner residual quantity, displaying the second prediction of toner residual quantity.

23. An image forming apparatus that displays a toner residual quantity, comprising:

a toner supply unit that includes a toner supply motor;

a developing unit that consumes toner supplied by the toner supply motor;

a calculation unit that calculates a first prediction of a toner residual quantity in the toner supply unit according to a dot count of printing data and that calculates a second prediction of toner residual quantity according to a total actuating time of the toner supply motor;

a determination unit that determines whether the second prediction of toner residual quantity is within a predetermined range of the first prediction of toner residual quantity; and a user interface unit that displays the second prediction of toner residual quantity if the second prediction of toner residual quantity is within a predetermined range of the first prediction of toner residual quantity.

* * * * *